US011428466B2

(12) United States Patent
Kurtz et al.

(10) Patent No.: US 11,428,466 B2
(45) Date of Patent: Aug. 30, 2022

(54) COLD BOX STEEL STRUCTURE AND METHOD FOR PREFABRICATING AND TRANSPORTING SAME

(71) Applicant: L'Air Liquide, Societe Anonyme pour l'Etude et l'Exploitation des Procedes Georges Claude, Paris (FR)

(72) Inventors: Remy Kurtz, Hangzhou (CN); Lasad Jaouani, Hangzhou (CN); Vincent Gueret, Hangzhou (CN)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 134 days.

(21) Appl. No.: 16/716,636

(22) Filed: Dec. 17, 2019

(65) Prior Publication Data

US 2020/0191478 A1 Jun. 18, 2020

(30) Foreign Application Priority Data

Dec. 17, 2018 (CN) ..... 201811542355.8

(51) Int. Cl.
*F25J 3/00* (2006.01)
*F25J 3/04* (2006.01)

(52) U.S. Cl.
CPC ..... *F25J 3/04945* (2013.01); *F25J 3/0489* (2013.01); *F25J 3/04872* (2013.01)

(58) Field of Classification Search
CPC ..... B66F 9/00; B66F 9/02; F25J 3/00; F25J 3/02; F25J 3/04975; F25J 3/0489;
(Continued)

(56) References Cited

U.S. PATENT DOCUMENTS 9,285,164 B2 3/2016 Wilhelm
2010/0162756 A1* 7/2010 Clodic ..... F25J 3/04945 62/643

(Continued)

FOREIGN PATENT DOCUMENTS

CN 1 666 001 9/2005

*Primary Examiner* — Jianying C Atkisson
*Assistant Examiner* — Erik Mendoza-Wilkenfel
(74) *Attorney, Agent, or Firm* — Justin K. Murray

(57) ABSTRACT

Disclosed in the present invention are a cold box steel structure and method for prefabricating and transporting the cold box steel structure. The cold box steel structure is a cuboid architecture, and has a long edge, a wide edge and a high edge of lengths L, W and H respectively, wherein L>W and L>H; the cold box steel structure comprises first and second rectangular base faces, each being an outer surface of the cuboid architecture comprising the long edge and the wide edge, and the cold box steel structure is prefabricated as two partial components taking a plane parallel to the rectangular base faces as a boundary; the total height of a first partial cold box steel structure component thereof, taking the first rectangular base face as a first transportation bottom face, is h1, and the total height of a second partial cold box steel structure component, taking the second rectangular base face as a second transportation bottom face, is h2; if the height difference between the transportation bottom face and the ground or a water surface is h, then (h1+h) corresponds to a transportation height of the first partial cold box steel structure component, and (h2+h) corresponds to a transportation height of the second partial cold box steel structure component; the transportation height of either of the cold box steel structure components should be smaller than a maximum permitted transportation height $h_{max}$.

19 Claims, 2 Drawing Sheets

(58) Field of Classification Search
CPC ..... E04B 1/34807; F17C 2205/0107; F17C 2205/0111; C10B 1/06
See application file for complete search history.

(56) References Cited

U.S. PATENT DOCUMENTS

| | | | | |
|---|---|---|---|---|
| 2013/0305643 | A1* | 11/2013 | Singleton | E04C 2/46 52/309.8 |
| 2018/0299199 | A1* | 10/2018 | Poulin | B65D 90/028 |
| 2019/0144081 | A1* | 5/2019 | Llago Hermida | B63B 25/00 114/71 |

* cited by examiner

COLD BOX STEEL STRUCTURE AND METHOD FOR PREFABRICATING AND TRANSPORTING SAME

CROSS REFERENCE TO RELATED APPLICATIONS

This application claim the benefit of priority under 35 U.S.C. § 119 (a) and (b) to Chinese patent application No. CN 201811542355,8, filed Dec. 17, 2018 the entire contents of which are incorporated herein by reference.

FIELD OF THE INVENTION

The present invention relates to a cold box steel structure, and also relates to a method for prefabricating and transporting the cold box steel structure.

BACKGROUND OF THE INVENTION

A cold box is a case which provides thermal isolation for cryogenic air separation equipment packaged therein. It consists of a steel structure architecture serving a supporting function and steel plates acting as panels for enclosure and protection; for thermal isolation, a thermally isolating material such as expanded perlite or rock wool is generally packed into the box.

A conventional air separation cold box is dispatched to a site in the form of loose parts, then on-site installation is performed according to the goods arrival situation. There is a large quantity of various types of components, equipment, pipelines and meters, etc., and it will often be the case that components are lost or cannot be found, or go missing in transit, or that the dispatching factory makes an error in dispatch; all of these scenarios will cause great inconvenience for on-site installation, and the project time limit may even be delayed. In addition, on-site installation conditions are restricted by factors such as site conditions, equipment, personnel and weather, so are far inferior to workshop assembly conditions, and quality cannot easily be guaranteed.

Technical personnel have thus proposed a way of prefabricating, in a workshop, a cold box case suitable for modular transport, i.e. a "package unit"; equipment components to be thermally isolated such as at least one rectification column are disposed inside the cold box steel structure, and steel plates are used as panels for enclosure and protection, to form an airtight case, which is transported together with the equipment components. The steel plates not only provide mechanical protection for the equipment components inside the case while the case is being transported, but also protect the equipment components from the effects of the weather. After transportation to the site, a thermal isolation effect can be achieved by packing the gaps between the equipment components and the cold box case with a thermally isolating material. This minimizes the workload of on-site installation to a certain extent.

In the case where a cold box case is prefabricated, the external dimensions of the cold box case generally determine the overall transportation dimensions of the package unit. The cold box case is generally a cuboid, and is generally transported with a longitudinal axis thereof parallel to the ground. If the height difference between a transportation bottom face and the ground is h, the transportation height (H+h) of the cold box case must satisfy highway transportation dimension limits.

According to relevant national mandatory regulations, highways, urban roads and railways generally have a height limit of 5.5 meters or less; at the present time, highway culverts generally all have an elevation of 4.5 meters or less. Thus, taking into account the height of a transporting vehicle, when the transportation height of the cold box case on the transporting vehicle is equal to or greater than the transportation dimension limit, the transportation of the cold box case in one piece will be difficult to perform; in such situations, equipment components such as the column body must be transported separately, and once the column body has arrived at the site, the cold box case is constructed around the equipment components. This requires a large amount of manpower to be arranged at the site, and is might be necessary to use an expensive crane to install the column body in the cold box case. If transportation is carried out by waterway or sea, transportation in one piece can generally always be accomplished as long as the bridge clearance, the vessel's transportation capability and the dock's loading/unloading capability are all sufficient.

In summary, as air separation equipment develops towards larger scales, equipment components such as the air separation internal column body are being made with ever increasing diameters, with the result that the dimensions of integrally prefabricated cold box steel structures are becoming larger, and very easily exceed transportation dimension limits during transportation. If equipment components are transported separately and the cold box case is then constructed on-site, the workload of on-site installation will be increased, and it may even be the case that the project time limit is delayed and installation quality is affected; expenditure in terms of manpower and material resources will also be increased.

SUMMARY OF THE INVENTION

In certain embodiments of the present invention, in order to solve the abovementioned technical problems, a cold box steel structure and a method for prefabricating and transporting the cold box steel structure are disclosed. By means of this structure and method, full use can be made of the concept of "package unit" to prefabricate modular cold box steel structure components in a workshop, and assemble equipment components inside the cold box steel structure components, transporting the cold box steel structure components together with the equipment components to a site, greatly reducing the workload of installing an air separation cold box from loose parts at the site. At the same time, due to the fact that an entire cold box is prefabricated as two partial cold box steel structure components, the transportation height of each cold box steel structure component can satisfy transportation dimension restrictions of highways or waterways, avoiding a situation where height restrictions are very easily exceeded when a cold box case is transported in one piece, improving transportation quality, and ensuring transportation safety.

The abovementioned object can be achieved principally in the following manner:

Cold box steel structure, being a cuboid architecture, and having a long edge, a wide edge and a high edge of lengths L, W and H respectively, wherein L>W and L>H; the cold box steel structure comprises first and second rectangular base faces, the first and second rectangular base faces each being an outer surface of the cuboid architecture comprising the long edge and the wide edge, and the cold box steel structure is prefabricated as two partial components taking a plane parallel to the rectangular base faces as a boundary;

the total height of a first partial cold box steel structure component thereof, taking the first rectangular base face as a first transportation bottom face, is h1, and the total height of a second partial cold box steel structure component, taking the second rectangular base face as a second transportation bottom face, is h2; if the height difference between the transportation bottom face and the ground or a water surface is h, then (h1+h) corresponds to a transportation height of the first partial cold box steel structure component, and (h2+h) corresponds to a transportation height of the second partial cold box steel structure component; the transportation height of either of the cold box steel structure components should be smaller than a maximum permitted transportation height $h_{max}$.

Preferably, the cold box steel structure is suitable for accommodating a set of cryogenic air separation equipment.

Preferably, steel plates acting as panels for enclosure and protection are installed on the first and second rectangular base faces.

Preferably, the transportation heights (h1+h) and (h2+h) of either of the cold box steel structure components are both at least 10 mm smaller than the maximum permitted transportation height $h_{max}$.

Preferably, the first partial cold box steel structure component is suitable for accommodating at least one component of the cryogenic air separation equipment.

Preferably, the component of the cryogenic air separation equipment is at least one rectification column and/or at least one heat exchanger and/or at least one set of pipelines.

Preferably, at least four side architectures are perpendicularly fixed to the first rectangular base face of the first partial cold box steel structure component.

Preferably, a number of oblique braces are disposed between the first rectangular base face and the side architecture of the first partial cold box steel structure component.

Preferably, at least four side architectures are perpendicularly fixed to the second rectangular base face of the second partial cold box steel structure component.

Preferably, the second partial cold box steel structure component is a cover plate structure.

Preferably, the second partial cold box steel structure component is suitable for accommodating an additional apparatus of the cryogenic air separation equipment.

Also disclosed in the present invention is a method for prefabricating and transporting the cold box steel structure: the first partial cold box steel structure component of total height h1 and the second partial cold box steel structure component of total height h2 are prefabricated separately using profiles in a prefabrication workshop; the two partial cold box steel structure components are laid on a transportation apparatus separately using the first and second rectangular base faces as transportation bottom faces, and after being transported to a site, are reconnected at an interface to form a complete cold box steel structure of height H.

Preferably, the profile is a U-shaped profile and/or an H-shaped profile and/or a round tube.

Preferably, the manner of connection of the interface of the first partial and second partial cold box steel structure components may be one or more of welding, riveting and bolt connection.

Preferably, the assembly of at least one component of the cryogenic air separation equipment is completed in a workshop, and carried out inside the first partial cold box steel structure component.

Preferably, the assembly of an additional apparatus of the cryogenic air separation equipment is completed in a workshop, and carried out inside the second partial cold box steel structure component.

Preferably, either of the cold box steel structure components is covered with triple-resistant cloth and nylon mesh during transportation.

The present invention has the following beneficial effects relative to the prior art:

1. The present invention makes full use of the concept of "package unit" to prefabricate modular cold box steel structure components in a workshop, greatly reducing the workload of installing an air separation cold box from loose parts at the site, and avoiding a situation where components go missing or errors are made in dispatch due to there being a large number of various components, equipment, pipelines and meters, etc.

2. Compared with a scheme whereby equipment components such as a column body are transported separately and a cold box case is constructed around the equipment components once the column body has arrived at the site, in the present invention, equipment components are assembled inside the cold box steel structure components, and the cold box steel structure components are transported to the site together with the equipment components, reducing the expenditure involved in arranging a large amount of manpower at the site and using an expensive crane to hoist the column body into the cold box case.

3. In the present invention, an entire cold box is prefabricated as two partial modular cold box steel structure components, and the transportation height of each cold box steel structure component can satisfy transportation dimension restrictions of highways or waterways, avoiding a situation where height restrictions are very easily exceeded when a cold box case is transported in one piece, improving transportation quality, and ensuring transportation safety.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE INVENTION

Figure 1:
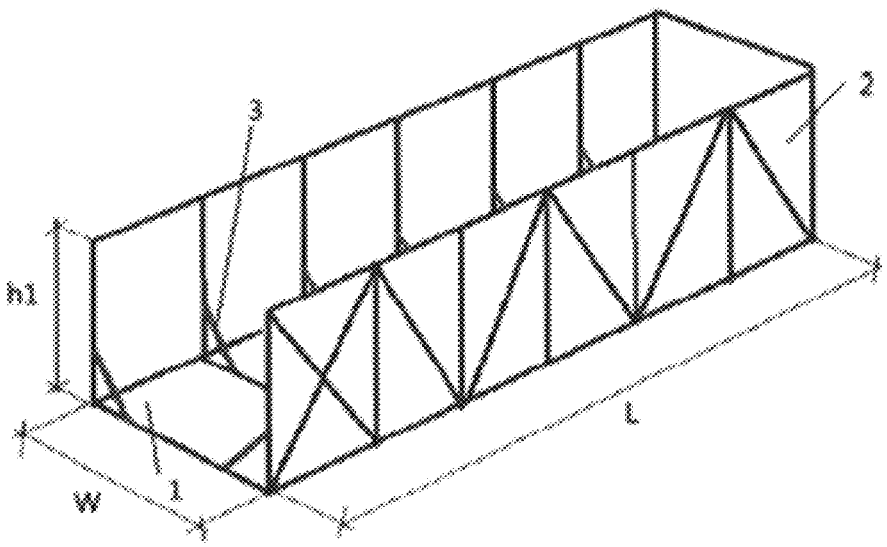
FIG. 1 is a three-dimensional structural schematic diagram of the first partial cold box steel structure component of the present invention.

Embodiments of the present invention are described further below with reference to FIGS. 1-5, which are in general schematic and, for the sake of clarity, not drawn to scale.

In this text, "cryogenic air separation equipment" means equipment required to perform air separation using the cryogenic method. The cryogenic method is a method which makes use of the differences in boiling points of the various components of air, liquefying air through a series of technological processes and achieving the separation of different components by rectification; the separation of these gases can only be accomplished in a low-temperature environment lower than 100 K. Cryogenic air separation equipment mainly consists of four main systems, namely an air compression system, an impurity purification and heat exchange system, a cooling system and liquefaction/rectification. The corresponding mechanical equipment includes an air turbine compressor, an air cooling column, a turbine expander and a rectification column, etc. In this text, equipment components in the cold box steel structure include an upper column and/or a lower column and/or a condenser/evaporator between the two columns; besides the abovementioned main equipment, there are also process pipelines connecting fluids, and additional apparatuses such as valves on the pipelines, meters, and electric cables for the meters.

In this text, the "cold box steel structure" is a cuboid architecture, employing a truss structure, and having a long edge, a wide edge and a high edge of lengths L, W and H respectively, wherein L>W and L>H. The cold box steel structure comprises first and second rectangular base faces, the rectangular base faces each being an outer surface of the cuboid architecture comprising the long edge and the wide edge.

The cold box steel structure is arranged longitudinally at the site, i.e. arranged with the long edge of the cuboid architecture perpendicular to the ground. A bottom face of the cold box steel structure is provided with a bottom beam structure for supporting a column body, and a top face is provided with top beams, with no storey boards in the middle. The truss structure has four perpendicularly arranged cold box posts, with multiple cold box crossbeams fixed uniformly in a perpendicular direction between pairs of cold box posts and enclosing rectangular plane frames. In a truss unit formed of three cold box crossbeams, namely upper, lower and middle cold box crossbeams, two cold box diagonal struts arranged in an intersecting manner are installed, with the point of intersection being located at the midpoint of the middle cold box crossbeam. Two endpoints of each cold box diagonal strut are respectively fixed to nodes where the upper and lower cold box crossbeams are connected to the cold box posts. The cold box posts are formed by welding together multiple post units made of steel section material one above the other. The cold box crossbeams located between two cold box posts are welded by cut-hole fusion penetration welding to the cold box posts via beam flanges at two ends, wherein beam webs are welded to the cold box posts using fillet welds. The cold box diagonal struts are connected by bolts via connecting plates at two ends to connecting plates welded to beam post units. The cold box bottom beams are formed by connecting bottom crossbeams by cut-hole fusion penetration welding between beam flanges, and beam webs of the bottom crossbeams are welded together using fillet welds; the cold box posts are connected to a post bottom plate by cut-hole fusion penetration welding.

In this text, "transportation of the cold box in one piece" means that the entire cold box steel structure, the assembly of equipment in the cold box and pipelines etc., and enclosure and protection with panels, are completed in a workshop, and transportation to a site is carried out with a longitudinal axis thereof parallel to the ground, in the form of an airtight case. The column body in the cold box is lowered directly onto the bottom beams of the cold box steel structure, and two saddle pedestal braces of the column body are disposed at suitable positions of the column body. 3-4 temporary pull rods are additionally disposed at a periphery of the column body, the temporary pull rods being connected to the cold box in order to keep the column body stable horizontally and transversely and being removable once on-site installation is complete. After transportation to the site, the interior of the cold box case is packed with a thermally isolating material, which may be expanded perlite or rock wool.

In this text, "cold box steel structure component" means that the abovementioned entire cold box steel structure is prefabricated as two partial module components in a workshop, taking a plane parallel to the rectangular base faces as a boundary, or that an entire cold box steel structure is manufactured in a workshop, and then cut into two partial module components. The assembly of equipment and pipelines, etc., is completed inside a first partial cold box steel structure component; the embodiments contain a concrete description of assembly through the provision of a track inside the cold box steel structure for pushing the column body into the cold box, and the fixing of the saddle pedestal braces of the column body to the cold box steel structure by welding.

As is the case with transportation of the entire cold box, the cold box steel structure components are also transported with a longitudinal axis thereof parallel to the ground, i.e. transported with the long edges of the cold box steel structure components parallel to the ground. The first partial cold box steel structure component is laid on a transportation apparatus with the first rectangular base face as a first transportation bottom face; a second partial cold box steel structure component is laid on the transportation apparatus with the second rectangular base face as a second transportation bottom face.

In this text, "interface" means a plane which is parallel to the first and second rectangular base faces and interposed between the first rectangular base face and the second rectangular base face. The entire cold box steel structure is divided into the first and second partial cold box steel structure components, taking this plane as a boundary; outer profiles of these two partial module components are still cuboids.

In this text, "four side architectures" and all the truss units on the first rectangular base face together form the first partial cold box steel structure component. The four sides comprise two symmetric faces extending along outer surfaces of the cuboid architecture comprising the long edge and the high edge, and two symmetric faces extending along outer surfaces of the cuboid architecture comprising the wide edge and the high edge; the truss structure on these four sides is perpendicular to the first rectangular base face. Before transportation, steel plates acting as panels for enclosure and protection are installed on the first rectangular base face and/or the four side architectures; in order to prevent the accumulation of rainwater or seawater, triple-resistant cloth and nylon mesh are generally used to cover the entire steel structure component during transportation.

In this text, "h1" is the perpendicular height from the first rectangular base face to the highest point of the first partial cold box steel structure component. Since the thicknesses of the triple-resistant cloth and nylon mesh can be ignored, L, W and h1 form the external dimensions of the first partial cold box steel structure component during transportation.

In this text, "h2" is the perpendicular height from the second rectangular base face to the highest point of the second partial cold box steel structure component. The assembly of additional apparatuses such as electric cables and/or meters is completed in the second partial cold box steel structure component; triple-resistant cloth and nylon mesh are also used to cover the entire steel structure component during transportation. L, W and h2 form the external dimensions of the second partial cold box steel structure component during transportation.

In this text, "maximum permitted transportation height $h_{max}$" is determined according to journey conditions between the workshop and the site. If only highway transportation is taken into account, then the minimum value of the height limits of highways, urban roads and railways and the elevations of highway culverts is taken as $h_{max}$. If a combination of highway and waterway transportation is used, then the minimum value of highway height limits and the elevations of actual bridges and culverts is taken as $h_{max}$. When transporting large and heavy objects, the following factors must be taken into account: load-bearing capacity restrictions of highway bridges which must be crossed; height restrictions of highway bridges and culverts; width restrictions; the maximum permitted turning radius of roads along the route, which determines the length of large objects being transported. A premise of the present invention is that the width, length and weight of the cold box steel structure all satisfy transportation restrictions, the aim being to resolve the issue of the height thereof being unable to satisfy transportation dimension restrictions of highways or waterways.

When transportation is carried out by highway, h is the height difference between a transportation bottom face of the cold box steel structure component and the ground, i.e. the distance between a lorry supporting surface, on which the cold box steel structure component is loaded, and the ground. When transportation is carried out by waterway, h is the height difference between a transportation bottom face of the cold box steel structure component and the water surface, i.e. the distance between a vessel supporting surface, on which the cold box steel structure component is loaded, and the water surface. It can thus be seen that h varies with the actual journey conditions. (h1+h) corresponds to the transportation height of the first partial cold box steel structure component, and (h2+h) corresponds to the transportation height of the second partial cold box steel structure component. The values of (h1+h) and (h2+h) also vary with the actual journey conditions, but it is a requirement that any one value should be smaller than the maximum permitted transportation height $h_{max}$, otherwise height restrictions will be exceeded.

Embodiments of the present invention are described further below with reference to FIGS. 1-5; these embodiments merely serve to demonstrate the content and spirit of the present invention, without any limiting effect.

Figure 5:
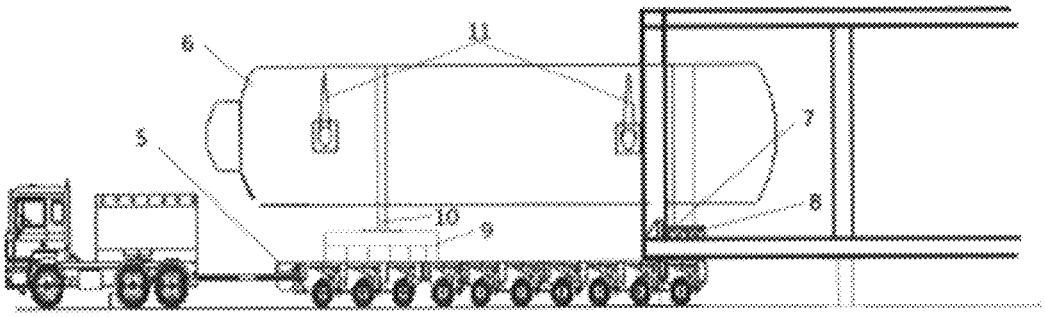
FIG. 5 shows schematically the steps of hoisting the column body into the cold box steel structure.

FIG. 1 is a three-dimensional structural schematic diagram of the first partial cold box steel structure component of the present invention. The first rectangular base face 1 is an outer surface of the cuboid architecture comprising the long edge and the wide edge; all of the truss units on the first rectangular base face are formed of U-shaped profiles and/or H-shaped profiles and/or round tubes, and steel plates acting as panels for enclosure and protection are installed on the first rectangular base face. A number of oblique braces 3 are disposed between the first rectangular base face 1 and a side architecture 2 perpendicular to the first rectangular base face. As the figure shows, h1 is the perpendicular height from the first rectangular base face to the highest point of the first partial cold box steel structure component. Once the first partial cold box steel structure component has been prefabricated in the workshop, the assembly of the column body and pipelines, etc., is completed inside the first partial cold box steel structure component (not shown in FIG. 1); FIG. 5 provides a concrete illustration of assembly through the provision of a track inside the cold box steel structure for pushing the column body into the cold box, and the fixing of the saddle pedestal braces of the column body to the cold box steel structure by welding.

Figure 2:
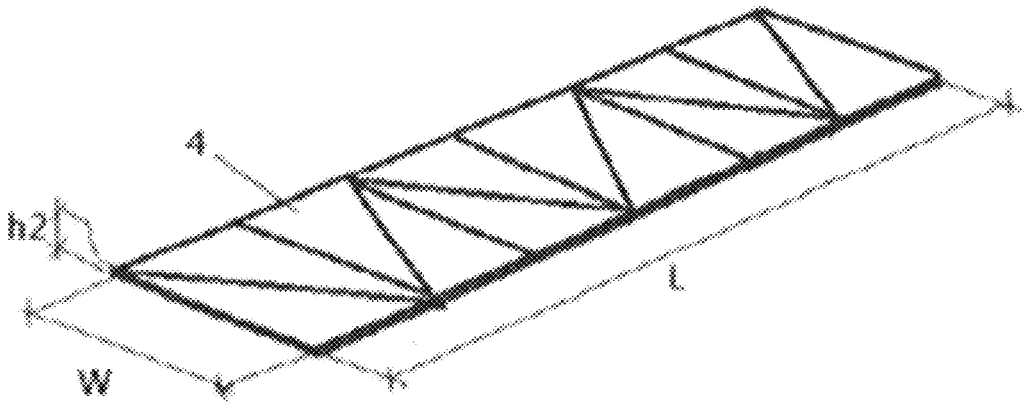
FIG. 2 is a three-dimensional structural schematic diagram of the second partial cold box steel structure component, being a cover plate structure, of the present invention.

FIG. 2 is a three-dimensional structural schematic diagram of the second partial cold box steel structure component, being a cover plate structure, of the present invention. The second partial cold box steel structure component in this embodiment does not have a side wall structure perpendicular to the second rectangular base face; in other words, all of the truss units and steel plates acting as panels for enclosure and protection on the second rectangular base face 4 together form as a cover plate structure of the first partial cold box steel structure component. As the figure shows, h2 is the perpendicular height from the second rectangular base face to the highest point of the second partial cold box steel structure component, i.e. the height of the cover plate structure in this embodiment. Once the second partial cold box steel structure component has been prefabricated in the workshop, the assembly of additional apparatuses such as electric cables and/or meters is completed in the second partial cold box steel structure component (not shown in FIG. 2).

Figure 3:
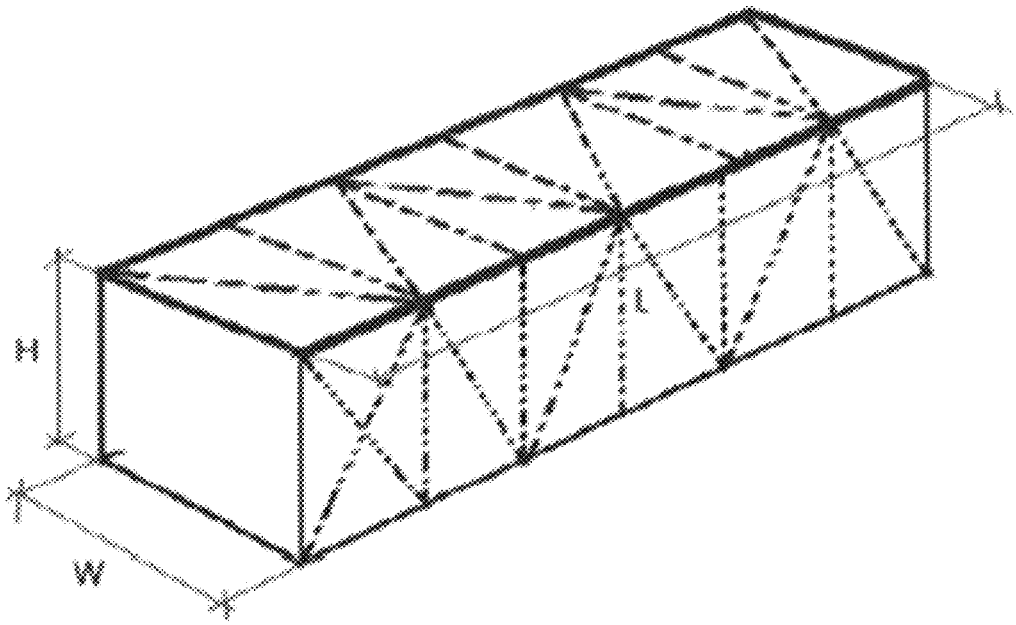
FIG. 3 is a three-dimensional structural schematic diagram of the two partial cold box steel structure components of the present invention connected to form a complete cold box steel structure after transportation to a site.

FIG. 3 is a three-dimensional structural schematic diagram of an airtight case in which the two partial cold box steel structure components of the present invention are connected to form a complete cold box steel structure after transportation to a site, using steel plates as panels for enclosure and protection; L, W and H form the external dimensions of the entire cold box steel structure, wherein H=h1+h2.

Figure 4:
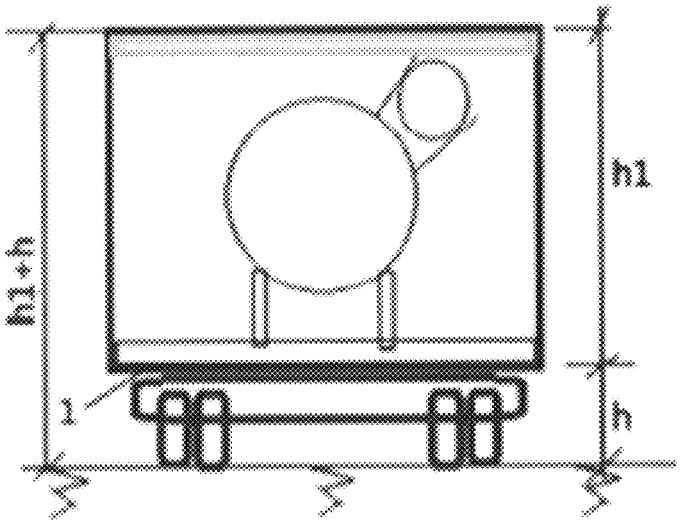
FIG. 4 shows schematically the transportation height of the first partial cold box steel structure component of the present invention on a transporting vehicle.

FIG. 4 shows schematically the transportation height of the first partial cold box steel structure component of the present invention on a transporting vehicle. The total height of the first partial cold box steel structure component, taking the first rectangular base face 1 as the first transportation bottom face, is h1. If the height difference between the transportation bottom face and the ground is h, then (h1+h) corresponds to the transportation height of the first partial cold box steel structure component. h varies with actual journey conditions; it is a requirement that any value of (h1+h) should be smaller than the maximum permitted transportation height $h_{max}$.

FIG. 5 shows schematically the steps of hoisting the column body into the cold box steel structure. A transport dolly carriage is prepared according to the dimensions of the track in the cold box steel structure and the weight of the column body; a flatbed truck 5 is used to move the column body 6 over a short distance to the vicinity of the cold box steel structure; after ensuring that the centers of the column body and the cold box steel structure lie on a straight line, one saddle pedestal brace 7 of the column body is placed on the transport dolly carriage 8 and welded intermittently, and a sleeper carriage 9 is adapted to the other saddle pedestal brace 10. Two mobile cranes 11 are used to lift the column body, and move it into the cold box steel structure; the pipelines on the column body cannot collide with the cold box steel structure. The flatbed truck is driven, such that the column body moves slowly along the track into the cold box steel structure by means of a tank carriage; once it has been ensured that the column body has been placed in a suitable position, the saddle pedestal brace of the column body is removed from the tank carriage, and fixed by welding to the cold box steel structure.

Although the content of the present invention has been presented in detail by means of the preferred embodiments above, it should be recognized that the descriptions above should not be regarded as limiting the present invention. Various amendments and substitutions to the present invention will be obvious after perusal of the content above by those skilled in the art. Thus, the scope of protection of the present invention should be defined by the attached claims.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A method for prefabricating and transporting a cold box steel structure, being a cuboid architecture, and having a long edge, a wide edge and a high edge of lengths L, W and H respectively, wherein L>W and L>H, the method comprising the steps of:

providing the cold box steel structure, wherein the cold box steel structure comprises:

first and second rectangular base faces, the first and second rectangular base faces each being an outer surface of the cuboid architecture comprising the long edge and the wide edge, and wherein the cold box steel structure is prefabricated as two partial components taking a plane parallel to the rectangular base faces as a boundary;

wherein the total height of a first partial cold box steel structure component of the two partial components is h1, and the total height of a second partial cold box steel structure component of the two partial components is h2, wherein the first rectangular base face is a first transportation bottom face and the second rectangular base face is a second transportation bottom face;

wherein if the height difference between the transportation bottom face and the ground or a water surface is h, then (h1+h) corresponds to a transportation height of the first partial cold box steel structure component, and (h2+h) corresponds to a transportation height of the second partial cold box steel structure component; the transportation height of either of the first or second partial cold box steel structure components is smaller than a maximum permitted transportation height $h_{max}$;

separately prefabricating the first partial cold box steel structure component of total height h1 and the second partial cold box steel structure component of total height h2 using profiles in a prefabrication workshop;

laying each of the two partial cold box steel structure components on separate transportation apparatus using the first and second rectangular base faces as transportation bottom faces;

transporting the two partial cold box steel structure components to a site; and connecting the two partial cold box steel structure components at an interface to form a complete cold box steel structure of height H.

2. The method according to claim 1, wherein the profile is a U-shaped profile.

3. The method according to claim 1, wherein the profile is an H-shaped profile.

4. The method according to claim 1, wherein the profile is a round tube.

5. The method according to claim 1, wherein the manner of connection of the interface of the first partial and second partial cold box steel structure components may be one or more of welding, riveting and bolt connection.

6. The method according to claim 1, wherein the assembly of at least one component of the cryogenic air separation equipment is completed in a workshop, and carried out inside the first partial cold box steel structure component.

7. The method according to claim 1, wherein the assembly of an additional apparatus of the cryogenic air separation equipment is completed in a workshop, and carried out inside the second partial cold box steel structure component.

8. The method according to claim 1, wherein either of the cold box steel structure components is covered with triple-resistant cloth and nylon mesh during transportation.

9. The method according to claim 1, wherein the cold box steel structure is configured to accommodate a set of cryogenic air separation equipment.

10. The method according to claim 9, wherein the first partial cold box steel structure component is suitable for accommodating at least one component of the cryogenic air separation equipment.

11. The method according to claim 10, wherein the component of the cryogenic air separation equipment is at least one rectification column and/or at least one heat exchanger and/or at least one set of pipelines.

12. The method according to claim 9, wherein the second partial cold box steel structure component is suitable for accommodating an additional apparatus of the cryogenic air separation equipment.

13. The method according to claim 12, wherein the additional apparatus of the cryogenic air separation equipment is an electric cable and/or a meter.

14. The method according to claim 1, wherein steel plates acting as panels for enclosure and protection are installed on the first and second rectangular base faces.

15. The method according to claim 1, wherein the transportation heights (h1+h) and (h2+h) of either of the cold box steel structure components are both at least 10 mm smaller than the maximum permitted transportation height $h_{max}$.

16. The method according to claim 1, wherein at least four side architectures are perpendicularly fixed to the first rectangular base face of the first partial cold box steel structure component.

17. The method according to claim 16, wherein a number of oblique braces are disposed between the first rectangular base face and the side architecture of the first partial cold box steel structure component.

18. The method according to claim 1, wherein at least four side architectures are perpendicularly fixed to the second rectangular base face of the second partial cold box steel structure component.

19. The method according to claim 1, wherein the second partial cold box steel structure component is a cover plate structure.

* * * * *